US006029386A

United States Patent [19]

Globig

[11] Patent Number: 6,029,386

[45] Date of Patent: Feb. 29, 2000

[54] FIREARM HOLDER

[76] Inventor: James E. Globig, 447 Claxton Glen Ct., Kettering, Ohio 45429

[21] Appl. No.: 09/108,134

[22] Filed: Jun. 30, 1998

[51] Int. Cl.[7] ..... F14A 27/00; A47F 7/00

[52] U.S. Cl. ..... 42/94; 42/85; 211/64

[58] Field of Search ..... 42/90, 94; 89/37.04, 89/34; 211/64

[56] References Cited

U.S. PATENT DOCUMENTS

| | | | |
|---|---|---|---|
| 879,052 | 2/1908 | Jeranek | 42/94 |
| 2,542,343 | 2/1951 | Merrill | 42/94 |
| 3,007,581 | 11/1961 | Moore | 42/94 |
| 4,792,050 | 12/1988 | Allen | 211/64 |
| 4,876,814 | 10/1989 | Lombardo | 42/94 |
| 4,987,694 | 1/1991 | Lombardo | 42/94 |
| 5,194,678 | 3/1993 | Kramer | 42/94 |
| 5,421,115 | 6/1995 | McKay | 42/94 |
| 5,491,920 | 2/1996 | McCullers | 42/94 |
| 5,685,103 | 11/1997 | Wiggins | 42/94 |
| 5,915,939 | 6/1999 | French | 42/85 |

*Primary Examiner*—Charles T. Jordan
*Assistant Examiner*—Denise J Buckley
*Attorney, Agent, or Firm*—Killworth, Gottman, Hagan & Schaeff, LLP

[57] ABSTRACT

A firearm holder for removably mounting a firearm on a vertical support is disclosed. The firearm includes a stock and a sling swivel stud mounted on the stock. The stock also has a first end, a second end on which the sling swivel stud is mounted, and a butt. The firearm holder comprises: a plate which is removably mountable on a vertical support, the plate having a first end and a second end; a stock support mounted on the second end of the plate, the stock support provided to engage the first end of the stock; an arm extending at an angle from the first end of the plate; and an engagement piece extending from the arm, the engagement piece being provided to engage the sling swivel stud of the firearm to maintain the firearm in a position perpendicular to the plate and to the vertical support when the butt of the stock is positioned against the plate and the stock support engages the first end of the stock.

19 Claims, 2 Drawing Sheets

FIREARM HOLDER

BACKGROUND OF THE INVENTION

The present invention relates to a firearm holder which is used to position a firearm against a vertical support such as a tree. The firearm holder of the present invention holds the firearm horizontal, i.e., generally to the ground, and in an upside-down position.

While hunting, a hunter will sit against a tree or in a tree stand to provide himself with a view of the surrounding terrain and to provide a vantage point for viewing approaching game. While waiting for game to appear it is neither comfortable nor feasible for a hunter to hold his firearm, as hours will often pass before game arrives. Further, the hunter may need to have both of his hands free to use game calls or attractants to lure game into range. During such activities, the hunter must have his firearm conveniently available for use at all times, as the appearance of game is often fleeting. A further hunting activities are carried out while it is raining or snowing. Precipitation of any kind can foul the sight of the firearm, causing the hunter to miss the game with an initial shot and causing the game to depart from the range of the firearm.

U.S. Pat. No. 2,542,343 to Merrill teaches a combination tool and gun support. The tool is attached to a tree by screw-threaded shank. A fork extends from the opposite end of the shank. The fork engages the trigger guard of the gun to "hang" the gun from the tool, parallel to the tree and with the barrel of the gun pointing upwardly.

U.S. Pat. No. 5,491,920 to McCullers teaches an adjustable firearm brace which is adapted to be attached to a tree or to a hunter's blind. The brace comprises a base, an attaching means for attaching the base to a support, an arm, and a means for supporting the firearm. The first end of the arm is pivotally connected to the base for general horizontal rotation of the second end of the arm about the base. A means for supporting the first end of the firearm is connected to the second of the arm and extends outwardly therefrom. The brace is attached to the support so that at least a portion of the arm is positioned above the hunter's head when the hunter is in a shooting position. The first end of the firearm is rested on the means for supporting the firearm. The arm is designed to move with the first end of the firearm to allow tracking of a target. This device holds the firearm with its sights directed upwardly. Further, this device allows the gun to sway in a breeze, possibly spooking game.

U.S. Pat. No. 5,685,103 to Wiggins also discloses a gun support for a gun having a scope mounted thereon. The support comprises a plate adapted to be attached to a tree by the use of an adjustable strap that surrounds the tree, an arm pivotally attached to the plate and extending therefrom so that an elastic member may be attached to the end of the arm distal from the plate, and a harness having a body and a first and second belt connected to the elastic member. The first and second belt encircle the front end and back end, respectively, of the scope and support the gun. The first and second belts are adjustable so that the gun can be balanced within the harness. This device also holds the gun with its sights directed upwardly and with the scope also directed upwardly. The device also allows the gun to sway during a breeze and spook potential game.

Thus, a need exists for a firearm holder which will hold the firearm in a horizontal position such that the sights can not be fouled by precipitation, and such that the firearm will not move in a breeze causing potential game to be spooked. Such a device should be easy to assemble and mount to a tree or other vertical support. A need exists for a compact firearm holder that holds the firearm such that it is substantially perpendicular to the tree or other vertical support.

SUMMARY OF THE INVENTION

The present invention solves the current need by providing a firearm holder which will hold a firearm in a position such that the sights can not be fouled by precipitation and so that the firearm will not move in a breeze causing potential game to be spooked. The firearm holder of the present invention is easy to assemble and to mount to a tree or other vertical support.

The present invention is directed to a firearm holder for removably mounting a firearm on a vertical support. The firearm includes a stock and a sling swivel stud mounted on the stock. The stock also has a first end, a second end on which the sling swivel stud is mounted, and a butt. The firearm holder comprises a plate which is removably mountable on a vertical support. The plate has a first end and a second end. A stock support is mounted on the second end of the plate. The stock support is provided to engage the first end of the stock. An arm extends at a downward angle from the first end of the plate. An engagement piece extends from the arm. The engagement piece is provided to engage the sling swivel stud of the firearm to maintain the firearm in a position perpendicular to the plate when the butt of the stock is positioned against the plate and the stock support engages the first end of the stock.

Desirably, the stock support is slidably mounted on the plate so that the firearm holder may be adjusted to accommodate firearms having butts of different sizes. The stock support is adjustably mounted on the plate by a dovetail arrangement which is formed by a slot defined by the plate and a flanged portion on the stock support which engages the slot to mount the stock support for sliding movement on the plate. The firearm holder may additionally include a thumbscrew which engages the stock support so that the stock support is adjustable by the thumbscrew on the plate. The firearm holder may also include an aperture formed in one end of the stock support and a flange which extends perpendicularly from the second end of the plate and which includes a threaded aperture so that the second thumbscrew engages the threaded aperture in the flange such that rotation of the second thumbscrew moves the stock support toward and away from the first end of the plate.

The stock support may include a support portion which engages the first end of the firearm stock. The support portion is shaped to prevent movement of the firearm when the firearm is mounted in the mount. Desirably, the support portion has either a V-shape or a U-shape.

It is further desirable that the arm has a threaded aperture formed therein and the engagement piece is a first thumbscrew which engages the threaded aperture. The first thumbscrew includes a head which is provided to engage the sling swivel stud of the firearm and the first thumbscrew is adjustable to engage sling swivel studs positioned at different positions on the stock of the firearm. It is further desirable that the head of the first thumbscrew has at least one recessed portion formed therein to facilitate engagement between the head of the first thumbscrew and the sling swivel stud. It is even more desirable that first thumbscrew includes at least two recessed portions formed therein so that the first thumbscrew can engage the sling swivel stud at two different axial positions.

It is desirable that the firearm holder further include a sling swivel stud which is mountable on the firearm. The stud includes a first aperture through which a sling is attached to the firearm and a second hole which can be used to pull the firearm up the vertical support from the ground. The sling swivel stud is engageable with or by the thumbscrew.

Objects and advantages of the invention will be apparent from the following detailed description, the accompanying drawings and the appended claims.

DETAILED DESCRIPTION OF THE INVENTION

Figure 1:
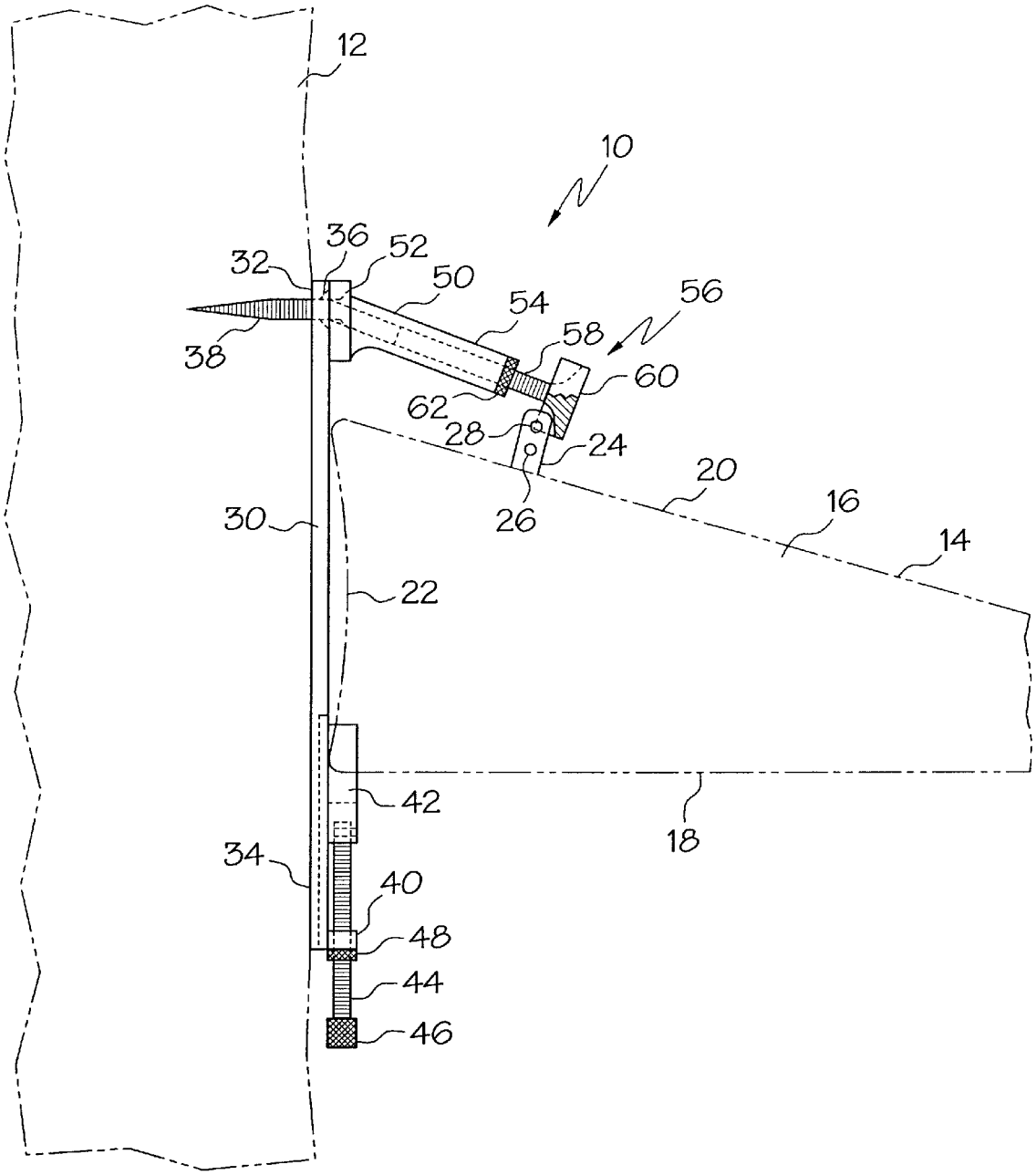
FIG. 1 presents a side view of the firearm holder of the present invention and shows a firearm stock in phantom lines.
Figure 2:
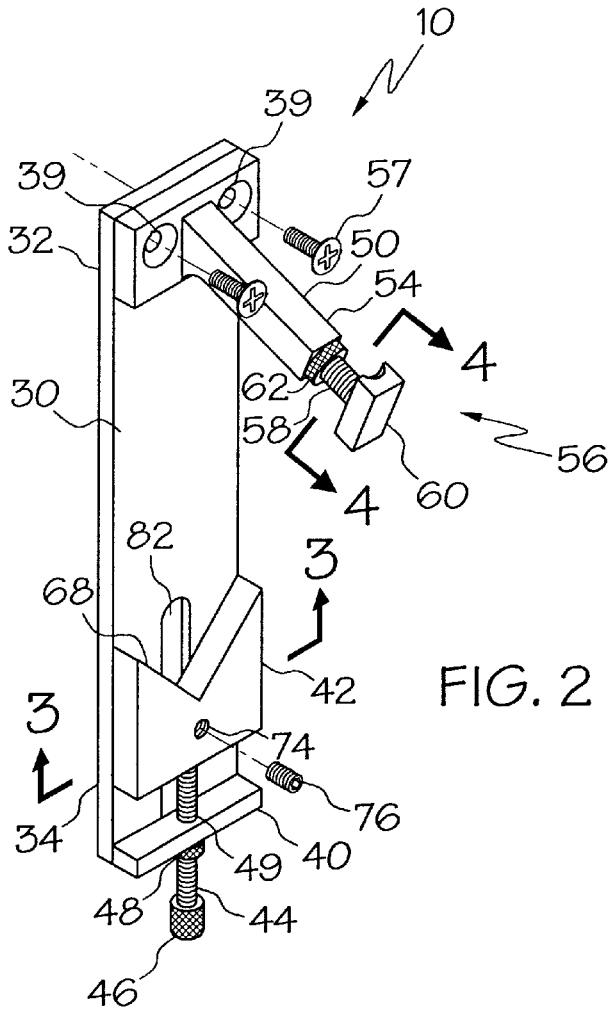
FIG. 2 presents a perspective view of the firearm holder of the present invention.

The firearm holder 10 of the present invention is shown in FIGS. 1 and 2. The firearm holder 10 is mounted on a vertical support 12, shown in phantom lines, and supports a firearm 14, shown in phantom lines. The firearm 14 includes a stock 16. The stock 16 has a first, top end 18 and a second, bottom end 20. The stock 16 terminates in a butt 22 which is placed against the shoulder of the user when using the firearm 14. A sling swivel stud 24 is mounted on the second end 20 of the stock 16 and is used to retain a sling which is used to carry the firearm 14. The sling swivel stud 24 includes a first aperture 26 and a second aperture 28. The firearm 14 is supported in the mount 10 perpendicular to the vertical support 12 and in an upside-down position.

The firearm holder 10 includes a plate 30 having a first end 32 and a second end 34. A threaded fastener 38 extends from plate 30 and secures the holder 10 to vertical support 12. The fastener may be a screw which is secured in place in an opening (not shown) in plate 30 by a weld or by other means. For example, fastener 38 may have a square or hexagonal head which is received in a mating recess in plate 30. Preferably, the fastener 38 is formed from steel to allow it to penetrate the hardest wood. A flanged portion 40 extends perpendicularly from the second end 34 of the plate 30. Fastener 38 has a hex or square head so the plate can be used to turn the screw into the tree.

A stock support 42 is mounted on the second end 34 of the plate 30. Desirably, the stock support 42 is mounted so that it is vertically adjustable on the plate 30. The stock support 42 is provided to support the first end 18 of the stock 16, as shown in FIG. 1. A thumbscrew 44 extends through flanged portion 40 and engages the stock support 42. The thumbscrew 44 has a head 46. A locknut 48 is positioned between flanged portion 40 and the head 46 of thumbscrew 44.

As can be seen in FIG. 2, the thumbscrew 44 also engages a threaded aperture 49 in the flanged portion 40 which extends from the second end 34 of the plate 30. As stated above, the locknut 48 is positioned on thumbscrew 44 between flanged portion 40 and the head 46 of thumbscrew 44.

As shown in FIG. 1 and FIG. 2, an arm 50 is mounted on and extends at a downward angle from the first end 32 of the plate 30. Desirably, the downward angle approximates the angle of the second end 20 of the firearm 14. The arm 50 includes a base 52, which is mounted on the plate 30, and an end 54 opposite the base 52. A pair of apertures 39 are formed in base 52. A pair of fasteners 57 extend through apertures 39 and engage threaded openings (not shown) in the first end 32 of plate 30. An engagement piece 56 extends from the end 54 of arm 50 to engage the sling swivel stud 24 of the firearm 14. Desirably, the engagement piece 56 is a thumbscrew 58 having a head 60. A locknut 62 is positioned between the end 54 of the arm 50 and the thumbscrew 58.

With reference to FIG. 2, the stock support 42 includes a support portion 68 which engages the first end 18 of the stock 16. The support portion 68 can have any shape which facilitates engagement with the stock 16. Desirably, the support portion 68 will have a V-shape, as shown in FIG. 2, or a U-shape. The support portion 68 engages a slot 82 which is formed in the plate 30 to slidably mount the support portion 68 on the plate 30.

Figure 3:
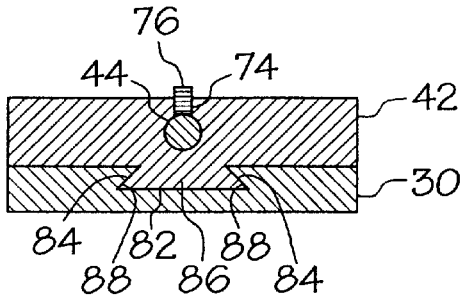
FIG. 3 presents a cross sectional view of the stock support.

A cross sectional view of the stock support 42 is shown in FIG. 3. As can be seen in FIG. 3, the stock support 42 includes an aperture 74 which is engaged by the thumbscrew 44. Desirably, the aperture 74 is untapped to allow free rotation of the thumbscrew 44. The thumbscrew 44 is held in position in the aperture 74 by a set screw 76 which engages the thumbscrew 44 perpendicularly to an unthreaded portion 78 of the thumbscrew 44. Alternatively, the thumbscrew 44 can be held in position by a pair of pins that engage the end of thumbscrew 44 in a manner similar to that shown for the engagement of the set screw 76 with the thumbscrew 44.

As can also be seen in FIG. 3, slot 82 is formed in plate 30. The slot 82 has angled sides 84. A flanged portion 86 extends from stock support 32. The flanged portion 86 has a pair of angled sides 88. The angled sides 88 of the flanged portion 86 engage the angled sides 84 of slot 82 in a dovetail manner so that stock support 42 is slidably mounted on plate 30.

Figure 4:
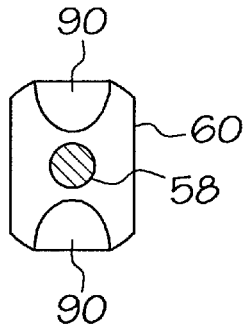
FIG. 4 presents a front view of the thumbscrew head.

A front view of the head 60 of the thumbscrew 58 is shown in FIG. 4. As can be seen in FIG. 4, the head 60 of thumbscrew 58 includes at least one indented, recessed portion 90 and desirably includes at least two indented, recessed portions 90. The recessed portion 90 is provided to facilitate engagement between the thumbscrew 58 and the sling swivel stud 24. Desirably, the recessed portions 90 are positioned so that thumbscrew 58 can be turned less than one revolution when adjusting thumbscrew 58 to the proper engagement position, as will be discussed below in more detail. As can also be seen in FIG. 4, the head 60 of thumbscrew 58 has an I-shape. Alternately, the head 60 may be round and include a plurality of recessed portions 90. Many other shapes, such as triangular, square or rectangular, may also be used for head 60 of thumbscrew 58.

The firearm holder 10 of the present invention functions in the following manner. Upon attaining a desirable spot in a vertical support 12, the hunter attaches the plate 30 to the vertical support 12 with the first end 32 being positioned above the second end 34. The plate 30 is retained in position on the vertical support 12 by the fastener 38 which extends from the first end 32 of the firearm holder 10. The firearm holder 10 is rotated as the fastener 38 is pressed against the support 12, effectively using plate 30 as a handle, and screwing the fastener into support 12. The locknut 62 and the thumbscrew 58 are then positioned in the arm 50, if they have not previously been positioned therein.

After the firearm holder 10 has been attached to the vertical support 12, the firearm 14 is then positioned in firearm holder 10. To position the firearm 14 in the firearm holder 10 properly, the stock support 42 must be positioned to support the stock 16. The stock support 42 is adjusted by turning thumbscrew 44. Turning the thumbscrew 44 in a first direction causes the stock support 42 to move toward the first end 32 of plate 30 and turning the thumbscrew 44 in a second direction causes the stock support 42 to move toward the second end 34 of the plate 30. Once the stock support 42 has been adjusted to the desired position, the thumbscrew 44 is secured in position by the locknut 48.

To position the firearm 14 in the firearm holder 10, the thumbscrew 58 must also be adjusted. The thumbscrew 58 is adjustable to engage sling swivel studs, such as sling swivel stud 24, which are positioned at different places on the stock 16. As stated above, the head 60 of thumbscrew 58 engages the sling swivel stud 24. Rotation of the head 60 of thumbscrew 58 moves the head 60 in a first direction toward the plate 30 and rotation of the head 60 in a second direction away from the plate 30. Once the proper positioning of the head 60 of the thumbscrew 58 has been determined, the firearm 14 is positioned in the firearm holder 10. One of skill in the art will appreciate that the positioning of the head 60 of thumbscrew 58 may take place before the positioning of stock support 42.

To position the firearm 14 in the firearm holder 10, the firearm 14 is turned so that the second end 20 is positioned above the first end 18. The barrel/muzzle of the firearm 14 is tilted slightly upward so that the sling swivel stud 24 fits beneath the engagement piece 56. The sling swivel stud 24 is then brought into contact with the engagement piece 56 and then the firearm 14 is rotated vertically about the contact point between the sling swivel stud 24 and engagement piece 56 until the butt 22 engages the plate 30. At this point, the first end 18 should engage the stock support 42. If the first end 18 does not engage the stock support 42, then the stock support 42 can be adjusted vertically to provide a proper support position for the firearm 14.

By positioning the firearm 14 in the firearm holder 10 of the present invention, the firearm 14 is maintained in a substantially horizontal, cantilevered, upside-down position. While in the upside-down position, the sights and action can not be fouled by precipitation. The firearm 14 is also positioned so that it extends perpendicularly from the vertical support 12 so that it can be quickly accessed. Finally, the firearm holder 10 of the present invention holds the firearm 14 so that it does not sway in a breeze.

The firearm 14 can be easily removed from the firearm holder 10. To remove the firearm 14 from the firearm holder 10, the barrel/muzzle of the firearm 14 is tilted upward so that the butt 22 moves away from the plate 30 and the first end 18 disengages from stock support 42. The firearm 14 then drops away from the engagement piece 56.

As shown in FIG. 4, the thumbscrew 58 desirably has at least one recessed portion 90 formed or machined into its head 60. The recessed portion 90 has the shape of the sling swivel stud 24 so that the sling swivel stud 24 matingly engages the head 60 of thumbscrew 58 to maintain the firearm 14 in position in the firearm holder 10 more securely. Desirably, the head 60 of thumbscrew 58 has at least two recessed portions 90 machined or formed therein so that the thumbscrew 58 can be adjusted to engage the sling swivel stud 24 without having to be turned for one complete revolution. Two or more recessed portions 90 allow for finer adjustment of the engagement between the head 60 of thumbscrew 58 and the sling swivel stud 24. To make for easy adjustment of the thumbscrew 58, the head 60 desirably has an I-shape with a recessed portion formed in each end of the "I." As described above, however, the head 60 of the thumbscrew 58 can take a variety of shapes and still be useful with the present invention.

Although the present invention is useful with a conventional sling swivel stud, it may be necessary to remove the sling from the conventional sling swivel stud before engaging the thumbscrew 58 with the sling swivel stud. To provide for more secure engagement between the thumbscrew 58 and the sling swivel stud, an extended sling swivel stud, such as sling swivel stud 24 which is shown is FIG. 1, is desirably used with the present invention. The extended sling swivel stud 24 replaces the conventional sling swivel stud. The extended sling swivel stud 24 has a height of from about 0.375 inches to about 0.625 inches. A conventional sling swivel stud has a height of 0.350 inches. The extended sling swivel stud 24 has the same shape as a conventional sling swivel stud but is longer than the conventional sling swivel stud to provide more area to engage thumbscrew 58. The extended sling swivel stud 24 of the present invention includes a first aperture 26 to which the sling may be attached. The extended sling swivel stud 24 may also include a second aperture 28 which is positioned above the first aperture 26. This second aperture 28 may be used to attach a line to the firearm so that the firearm 14 can be pulled up into a vertical support. The second aperture 28 is particularly useful because it allows the firearm to be pulled up into the vertical support 12 with its muzzle or barrel pointed downwardly.

The firearm holder 10 of the present invention can be formed from a variety of materials. The materials used to form the firearm holder 10 should be durable and rust resistant. Useful materials for forming the components of firearm holder 10 include metals, such as steel, stainless steel, and plastics, such as polycarbonate and high density polyethylene. The components of the firearm holder 10 can be formed from the same material or a different material. It is, however, desirable, that the fastener 38 be formed from steel. It is also contemplated that the firearm holder may have a two piece plastic construction in which the arm 50 is formed integrally with the plate 30 and the stock support 42 is formed from a separate piece of plastic so that it can be adjusted on the plate 30. It is also possible that each piece of the firearm holder 10 can be formed separately and assembled by the user of the firearm 14 at the desired location for use.

Having described the invention in detail and by reference to preferred embodiments thereof, it will be apparent that modifications and variations are possible without departing from the scope of the invention which is defined in the appended claims.

What is claimed is:

1. A firearm holder for removably mounting a firearm substantially horizontally on a vertical support, the firearm including a stock and a sling swivel stud mounted on the stock, the stock also having a first end, a second end on which the sling swivel stud is mounted, and a butt, said firearm holder comprising:

a plate which is mountable on a vertical support, said plate having a first end and a second end;

a stock support mounted on said second end of said plate, said stock support provided to engage the first end of the stock;

an arm extending from said first end of said plate; and an engagement piece extending from said arm, said engagement piece being provided to engage the sling swivel stud of the firearm to maintain the firearm in a position substantially perpendicular to said plate and to said vertical support when the butt of the stock is positioned against said plate and said stock support engages the first end of the stock.

2. The firearm holder of claim 1 wherein said stock support is slidably mounted on said plate so that said firearm holder is adjustable to accommodate firearms having butts of differing sizes.

3. The firearm holder of claim 2 wherein said plate defines a slot and said stock support includes a flanged portion which engages said slot to mount said stock support on said plate for sliding movement.

4. The firearm holder of claim 1 wherein said arm has a threaded aperture formed therein and said engagement piece is a first thumbscrew which engages said threaded aperture, said first thumbscrew including a head which is provided to engage the sling swivel stud of the firearm and said first thumbscrew being adjustable to engage sling swivel studs positioned at different positions on the stock of the firearm.

5. The firearm holder of claim 4 wherein said head of said first thumbscrew has at least one recessed portion formed therein to facilitate engagement between said head of said first thumbscrew and said sling swivel stud.

6. The firearm holder of claim 5 wherein said first thumbscrew includes at least two recessed portions formed therein so that said first thumbscrew can engage the sling swivel stud at two different axial positions.

7. The firearm holder of claim 1 wherein said arm is removably mounted on said plate.

8. The firearm holder of claim 4 wherein said firearm holder additionally includes a second thumbscrew which engages said stock support so that said stock support is adjustable by said second thumbscrew on said plate.

9. The firearm holder of claim 8 wherein said firearm holder further includes an aperture formed in one end of said stock support and a flange which extends perpendicularly from said second end of said plate and which includes a threaded aperture so that said second thumbscrew threadedly engages said threaded aperture in said flange such that rotation of said second thumbscrew moves said stock support toward and away from said first end of said plate.

10. The firearm holder of claim 1 wherein said stock support includes a support portion which engages the first end of the firearm stock, said support portion being shaped to prevent movement of the firearm when the firearm is mounted in the mount.

11. The firearm holder of claim 9 wherein said support portion has either a V-shape or a U-shape.

12. The firearm holder of claim 1 wherein said arm and said plate have a one-piece construction.

13. The firearm holder of claim 1 wherein said plate, said stock support and said arm are formed from metal.

14. The firearm holder of claim 1 wherein said plate, said stock support and said arm are formed from a plastic material.

15. The firearm holder of claim 1 wherein said plate is mountable to the vertical support by at least one screw.

16. The firearm holder of claim 15 wherein said screw is a wood screw.

17. The firearm holder of claim 15 wherein said screw is formed from steel.

18. The firearm holder of claim 1 further including a sling swivel stud which is mountable on the firearm, said stud including a first aperture through which a sling is attached to the firearm and a second aperture which can be used to pull the firearm into a vertical support from the ground, said stud being engageable by said thumbscrew.

19. The firearm holder of claim 1 wherein said angle approximates an angle of the second side of the stock.

* * * * *